US008675908B2

(12) United States Patent
Pierce et al.

(10) Patent No.: US 8,675,908 B2
(45) Date of Patent: Mar. 18, 2014

(54) LOW COST PROGRAMMABLE SOUND RECORDING AND PLAYBACK DEVICE AND METHOD FOR COMMUNICATING WITH, AND RECHARGING OF, THE DEVICE

(76) Inventors: Harold D. Pierce, Westlake Village, CA (US); Steven Muenter, Sherman Oaks, CA (US)

( * ) Notice: Subject to any disclaimer, the term of this patent is extended or adjusted under 35 U.S.C. 154(b) by 99 days.

(21) Appl. No.: 13/506,681

(22) Filed: May 8, 2012

(65) Prior Publication Data

US 2012/0294473 A1 Nov. 22, 2012

Related U.S. Application Data

(60) Provisional application No. 61/518,685, filed on May 9, 2011.

(51) Int. Cl.

| | |
|---|---|
| ***H04R 9/06*** | (2006.01) |
| *H04R 1/02* | (2006.01) |
| *H04R 3/00* | (2006.01) |

(52) U.S. Cl.

CPC *H04R 9/06* (2013.01); *H04R 1/028* (2013.01); *H04R 3/00* (2013.01); *H04R 2400/01* (2013.01)

USPC ..... 381/396; 381/400; 455/41.1

(58) Field of Classification Search

USPC ..... 381/111, 116, 117, 150, 323, 396, 400, 381/412; 455/3.06, 41.1–41.3, 572–574

See application file for complete search history.

(56) References Cited

U.S. PATENT DOCUMENTS

| | | | | |
|---|---|---|---|---|
| 2005/0111681 | A1* | 5/2005 | Essabar | 381/315 |
| 2007/0098208 | A1* | 5/2007 | Wu | 381/400 |
| 2007/0109089 | A1* | 5/2007 | Flanders et al. | 336/220 |
| 2009/0285426 | A1* | 11/2009 | Boguslavskij | 381/323 |
| 2010/0142741 | A1* | 6/2010 | Plummer | 381/345 |

* cited by examiner

*Primary Examiner* — Tuan D Nguyen
(74) *Attorney, Agent, or Firm* — Duncan Palmatier

(57) ABSTRACT

A low cost sound recording and playback device and a low cost method for wirelessly communicating with, and recharging of, the device. The device utilizes commonly available electronic components generally included in electronic sound producing devices thereby allowing for lowest cost of manufacture. The device includes a low cost low-power processor, general purpose low-cost loudspeaker, and a power source. The method incorporates inductive coupling between an external communication and recharging device, and the internal loudspeakers voice coil of the device. Substantial reductions in cost and space savings are realized by utilizing the internal loudspeaker's voice coil for multiple purposes.

19 Claims, 14 Drawing Sheets

SOUND PRODUCING DEVICE AND COMMUNICATION INTERFACE

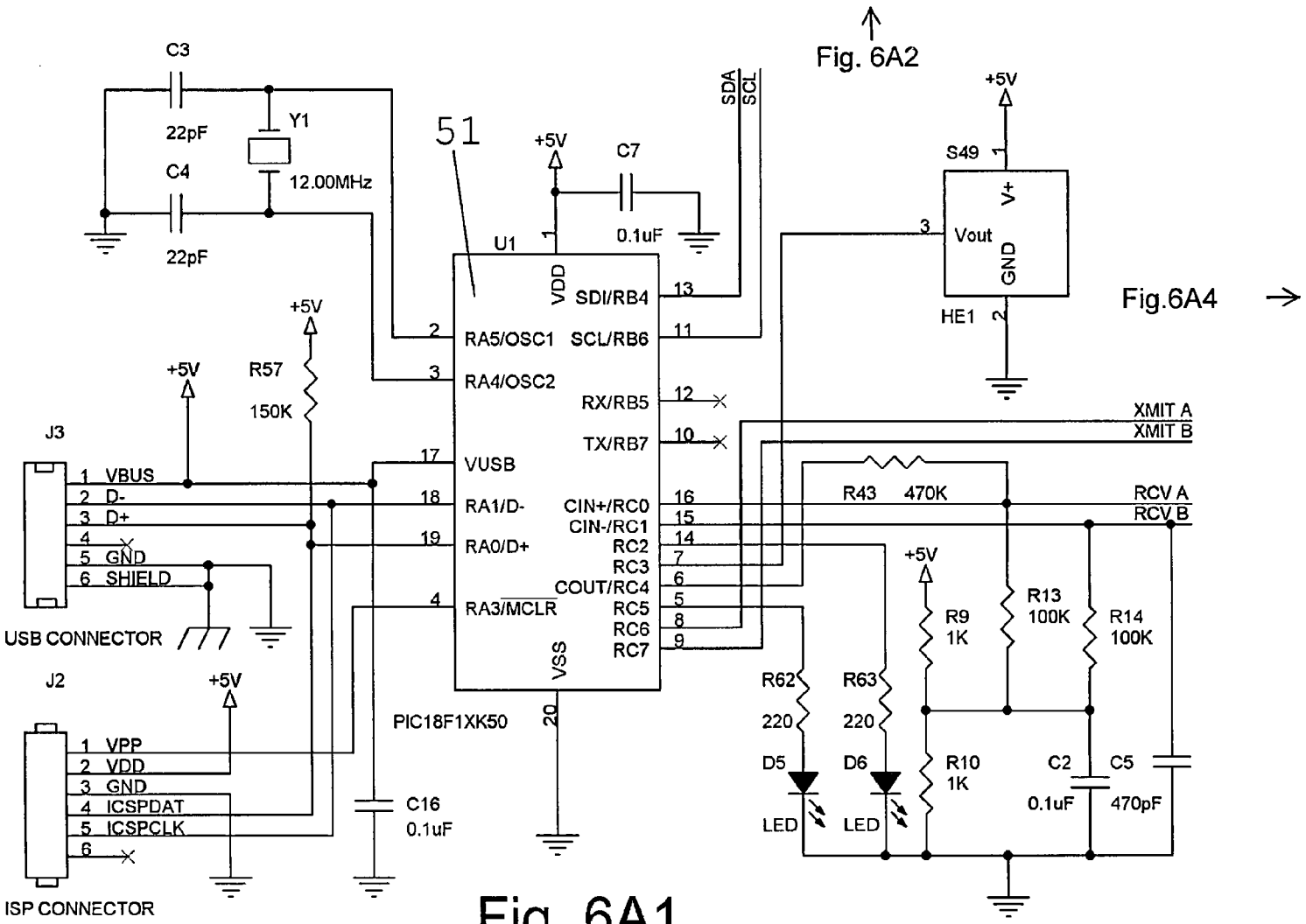
Fig. 6A1

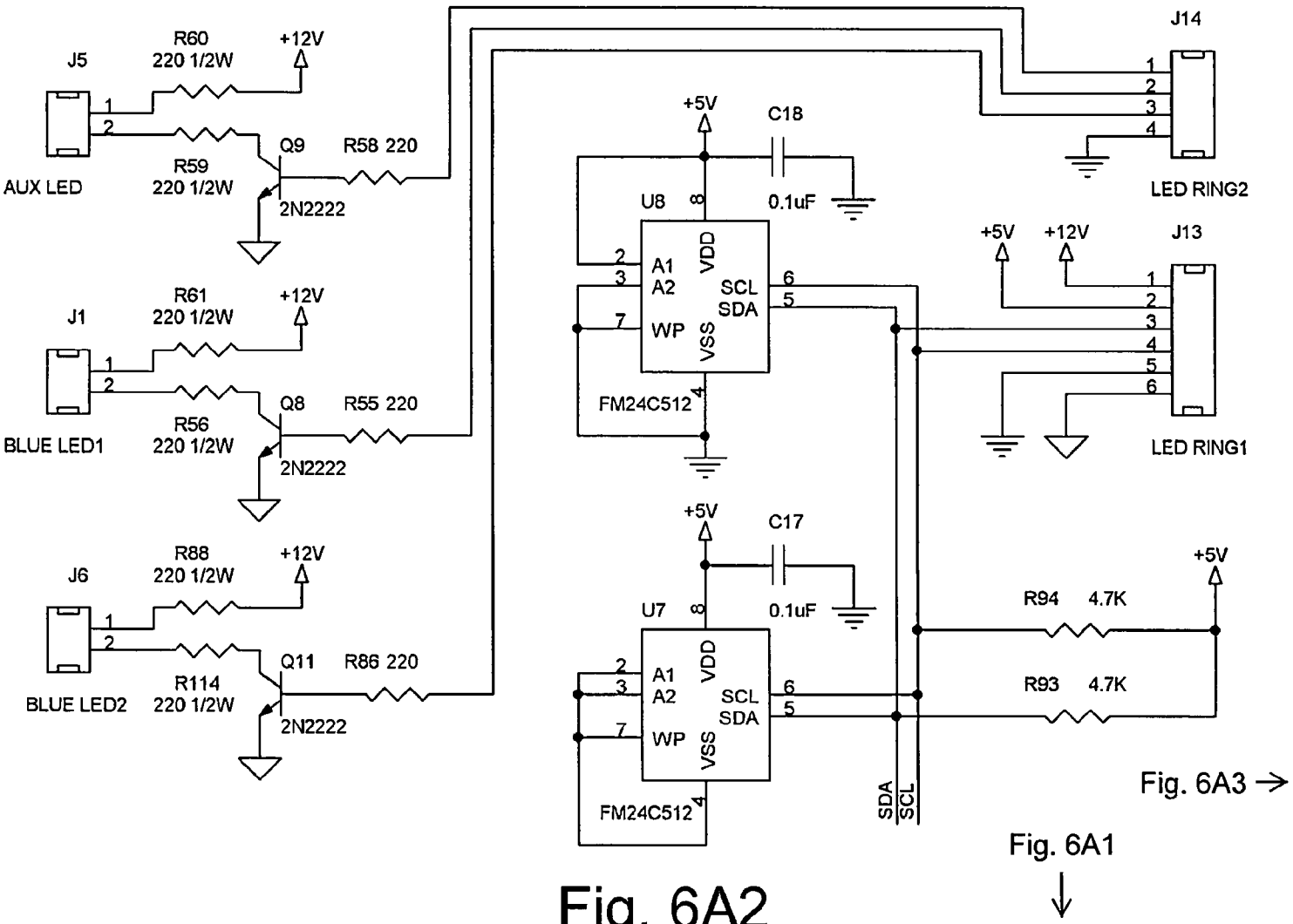
Fig. 6A2

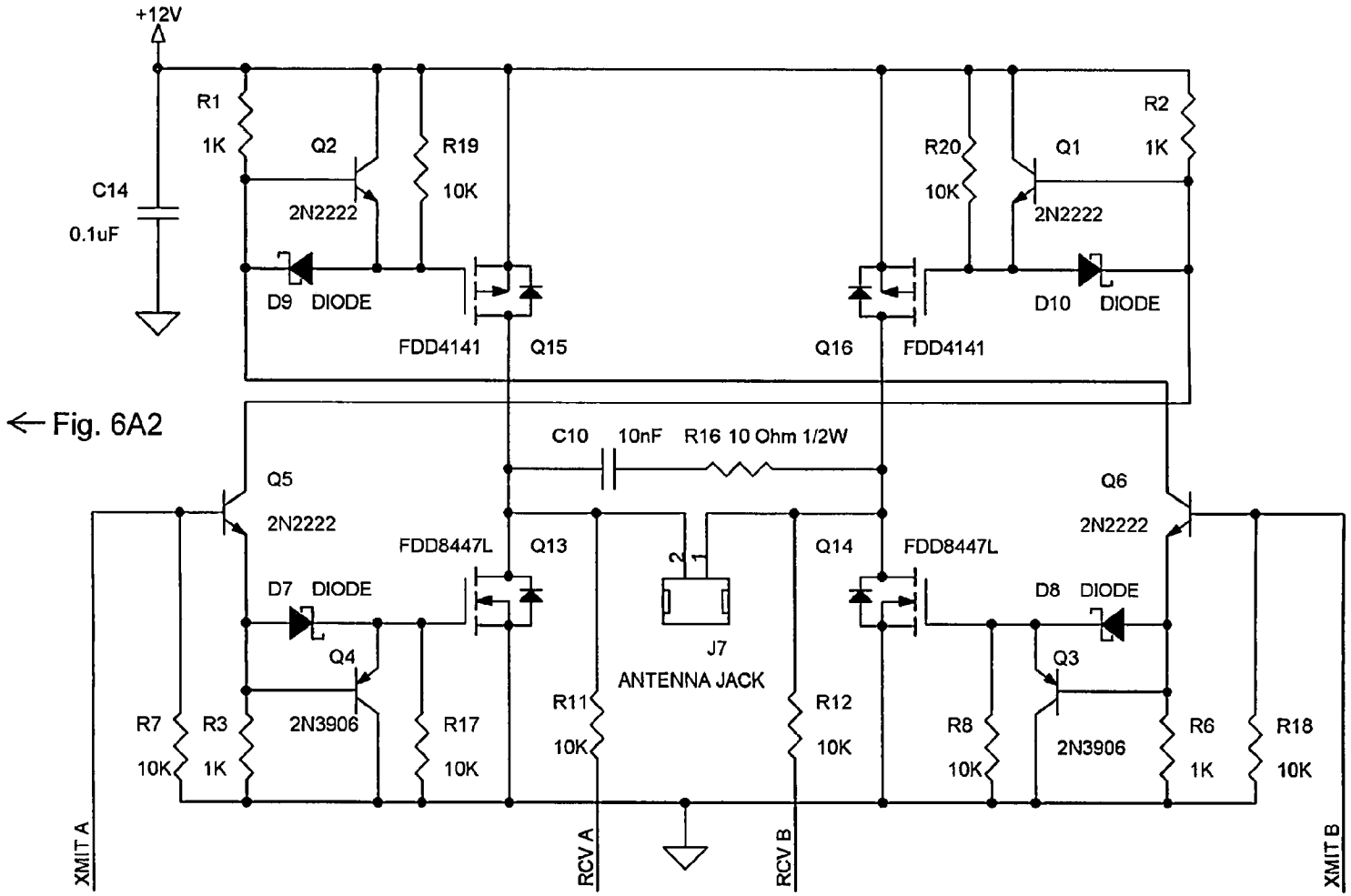
Fig. 6A2
Fig. 6A3
Fig. 6A4

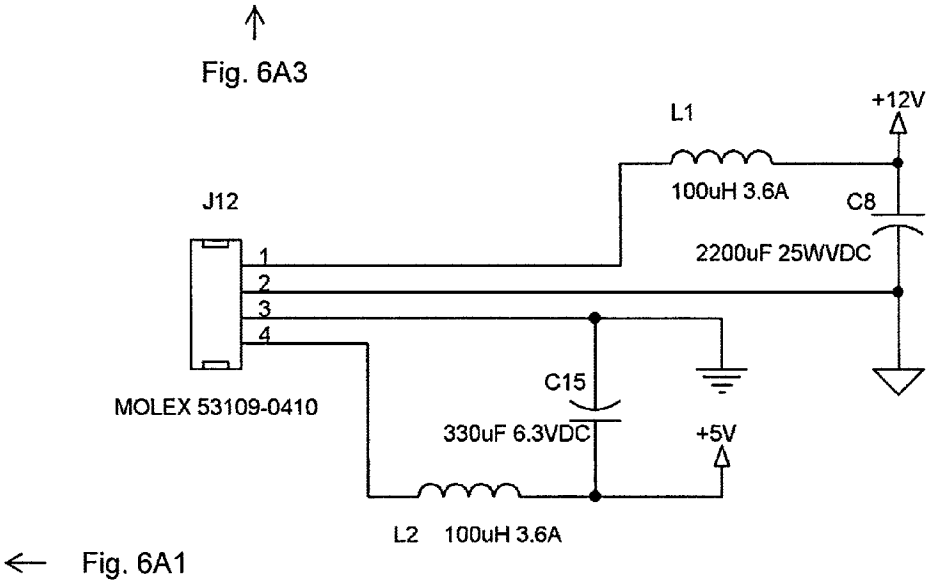
Fig. 6A4

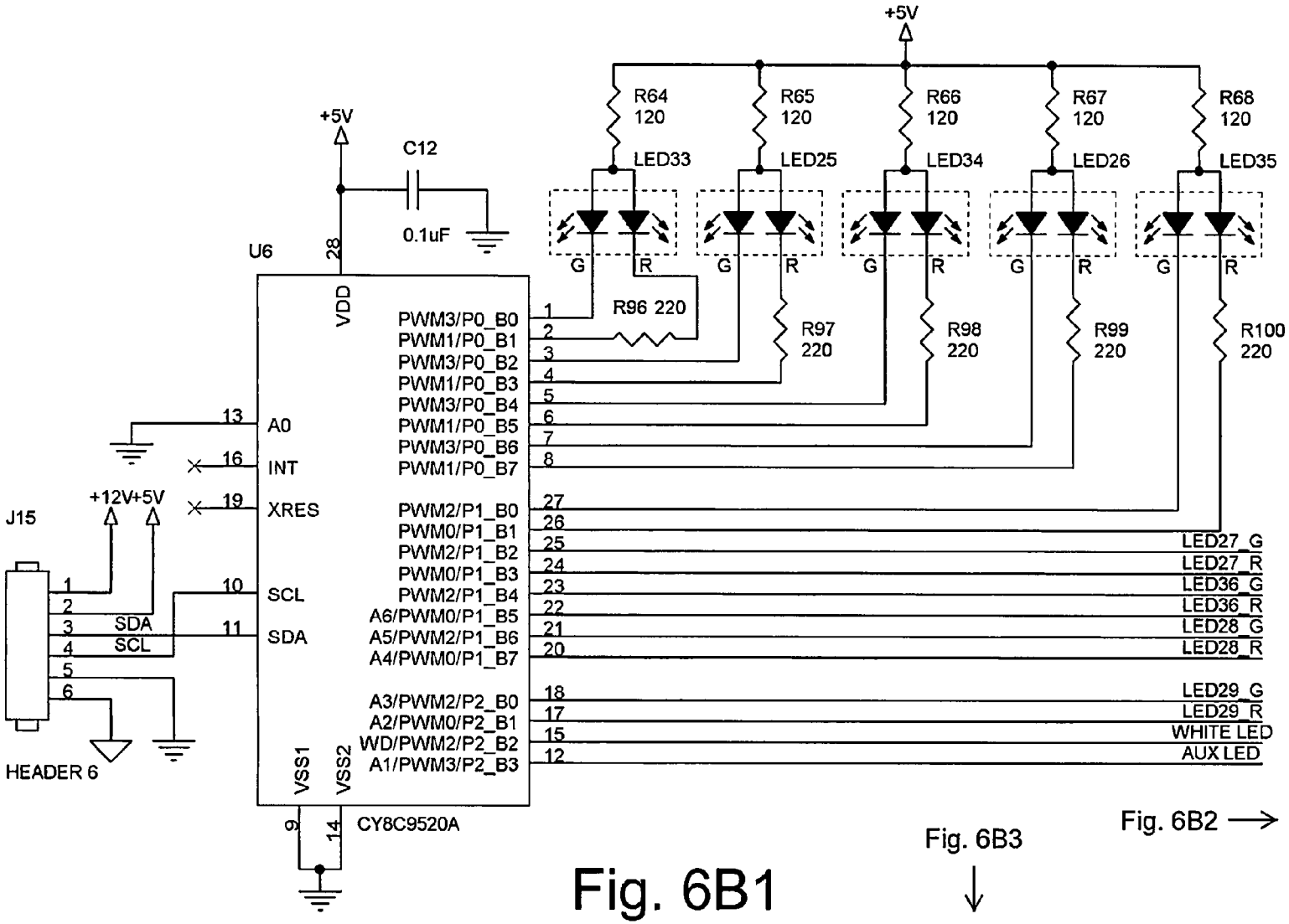
Fig. 6B1

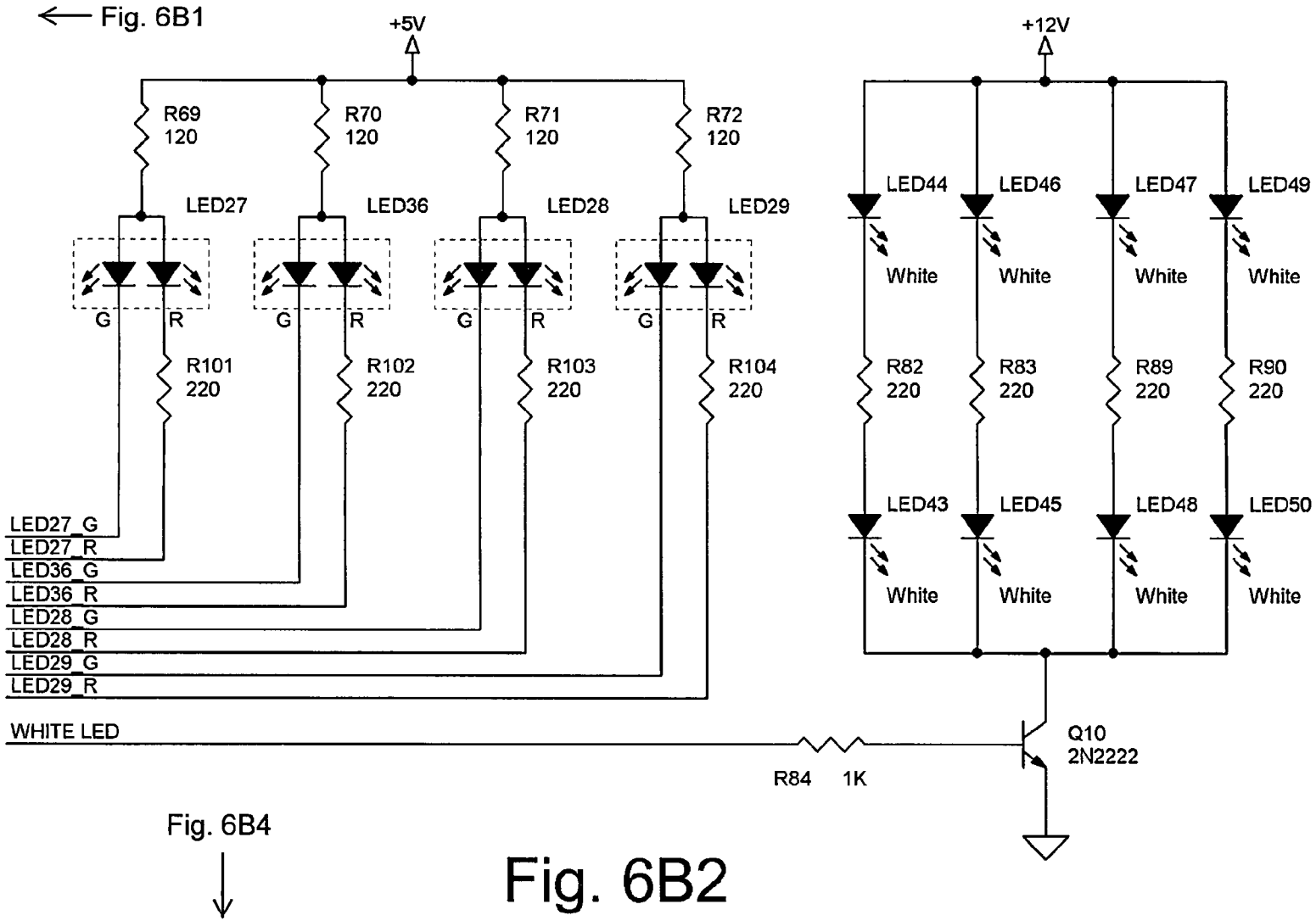
Fig. 6B2

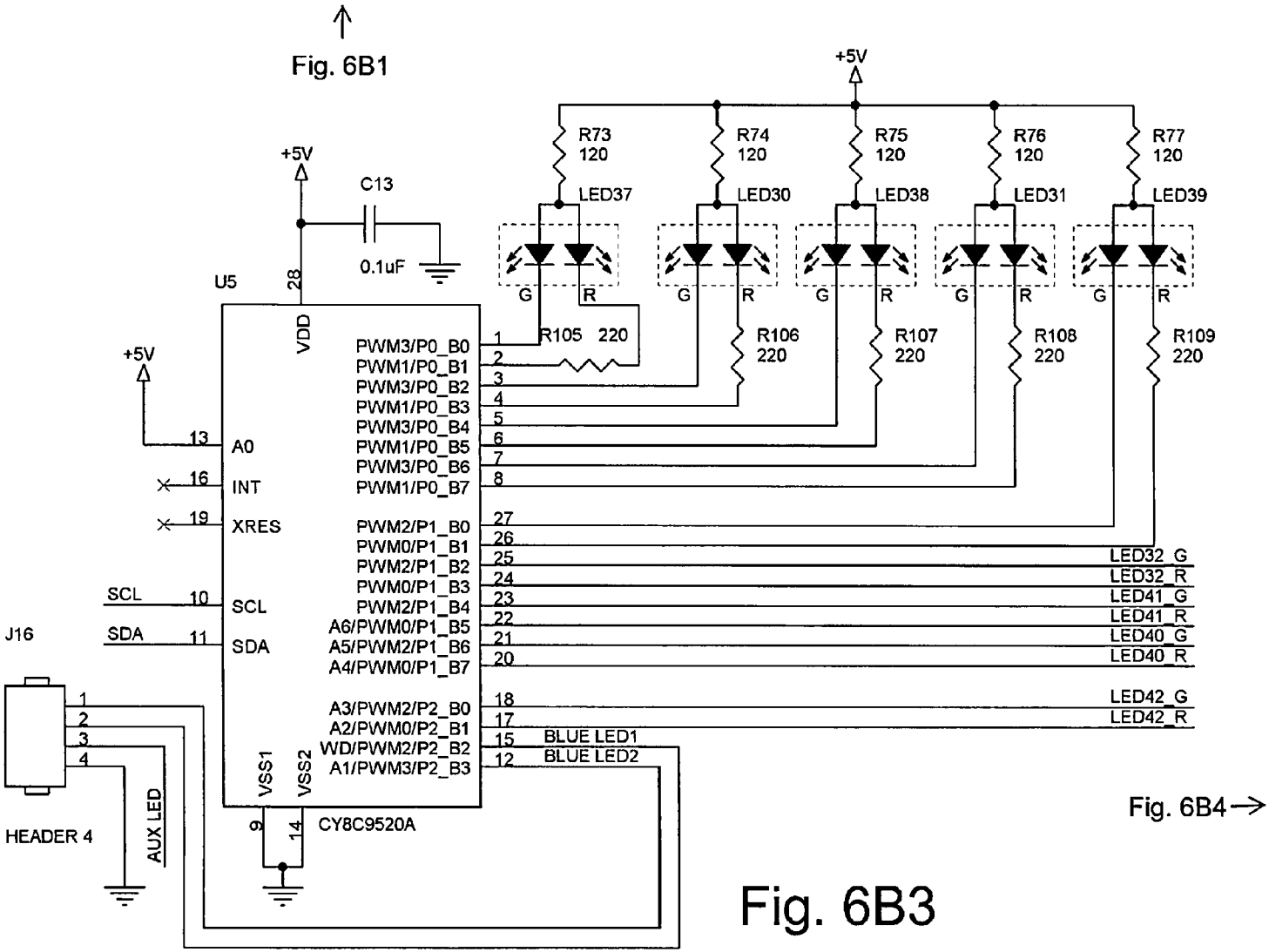
Fig. 6B3

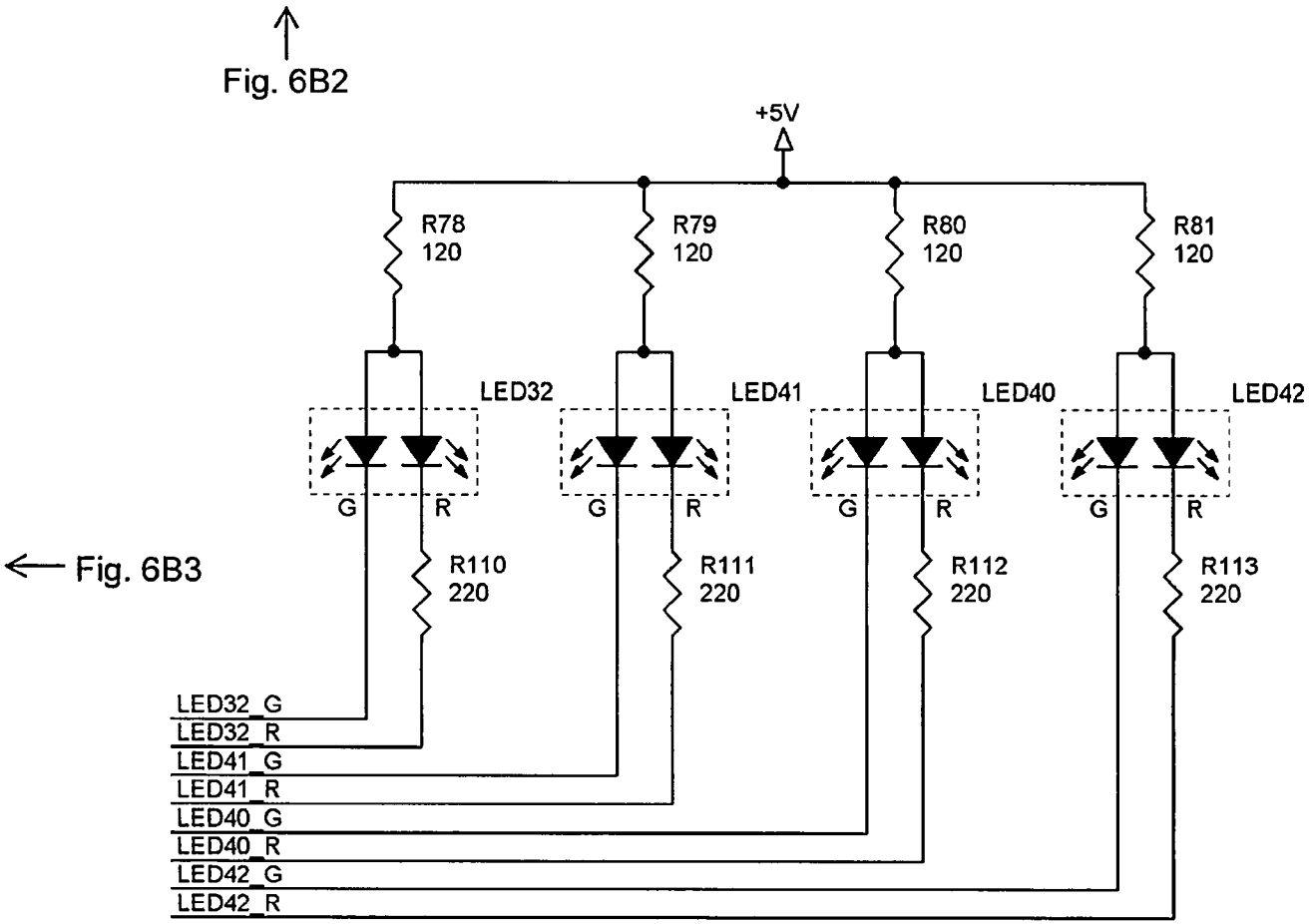
Fig. 6B4

LOW COST PROGRAMMABLE SOUND RECORDING AND PLAYBACK DEVICE AND METHOD FOR COMMUNICATING WITH, AND RECHARGING OF, THE DEVICE

CLAIM OF PRIORITY TO PROVISIONAL APPLICATION (35 U.S.C. §119(E))

This application claims priority under 35 U.S.C. §119(e) from provisional patent Application No. 61/518,685, filed May 9, 2011. The Application 61/518,685 is incorporated herein by reference.

BACKGROUND OF THE INVENTION

1. Field of the Invention

This invention relates to electronic sound recording and playback devices such as those found in greeting cards, stuffed animals, jewelry, games, etc. More particularly, the invention uses a dynamic speaker as an audio transducer, and as an antenna, for an inductive or modulated radio frequency data link, and as a pressure switch.

2. Description of Related Art

The advance of technology relating to the semiconductor industry has resulted in integrated circuits with more computing power in smaller packages that operate at lower voltages with less electrical power. One application area that has benefited from this advancement is electronic sound and music playback modules. These modules typically play a sound effect, music, or speech, through a speaker upon activation. The duration of the sound may be as short as one second or as long as a few minutes. These modules may be found in items such as greeting cards, plush toys, jewelry, etc.

The sounds that a conventional module may play are either incorporated into the module as a part of its design or recorded into the module after the module is manufactured. A module with a "canned" sound as part of its design is typically the most cost effective to produce in large numbers. For example, U.S. Pat. No. 5,356,296 to Pierce et al. discloses such a solution. A disadvantage of this method is that the initial, non-recurring costs of incorporating sound into a module are prohibitive for small production quantities. Also, the long design cycle and manufacturing lead times make it impossible to provide a sound module in response to unanticipated or unpredictable market need. For example, it is not economically viable to preorder "talking" merchandise celebrating a team's victory of a major sporting contest in anticipation of such a win. However, the manufacturing lead time after such an event precludes a timely supply of merchandise during the period of peak demand.

Often, it is desirable to have the capability of recording a custom message, music or sound effect for playback by the module. Such a module typically incorporates a microphone or other audio detector and a means for recording the audio into the memory of the module. Alternatively, the module may possess an electronic connector for receiving the analog audio or digitized audio for storage in the module's memory.

Recording the custom sound by means of a microphone has the advantage that there is no physical contact between the sound module and the audio program source. The disadvantage is that the sound quality is affected by the characteristics of the microphone. To minimize the cost of the module, an inexpensive microphone is typically used, but with the concomitant degradation of sound quality. Programming the memory of the module with an analog or digital version of the custom sound assures that the sound quality is not adversely affected by the data transfer process. However, this process requires human or machine intervention to mate an electrical connector between the programmer and the sound module. This method has the disadvantage of requiring physical contact between the programmer and the sound module. In addition, although the connector on the sound module will likely be used only once, the connector on the programmer will be used many times; once for programming each sound module. The repeated insertion and removal of a connector is problematic due to the effects of frictional wear and environmental contamination. In addition, the process of connecting and disconnecting of the module when used in a retail environment can be inconvenient and confusing to consumers. It is also known that such wired connections in the retail environment can be unreliable. Therefore, a preferred method for communicating with and programming a sound module would use a wireless or other system that does not require physical contact. There are numerous wireless communication systems available today, including radio frequency, optical, and inductive. Prior to this invention, all of the aforementioned technologies are disadvantaged by a substantial increase in cost to the sound module since they require substantial additional electronic circuitry and the addition of antennas, photo optical devices, or pick-up coils. Another disadvantage of these technologies is that a module must be made with components that are used only once during the recording of the custom sound. These components add to the size and cost of the module.

In view of the foregoing, there is a need in the art for a means of transferring custom sound into the memory of a module that does not require additional physical or wireless components to effect the transfer. In addition, there is a need for such a system that uses the same components already extant for the playback of the sound. In addition, it is desired that each component of the module is capable of performing multiple functions so that the total number of components is minimized, thereby reducing the physical size and cost of the module. These and other needs are met by the present invention as detailed hereafter.

SUMMARY OF THE INVENTION

Embodiments of this invention utilize the structure and operating characteristics of a dynamic loudspeaker to allow it to function as an audio transducer, an antenna for an inductive data link, a power link, and a pressure activated switch. The present invention is well suited to multiple applications. Selected embodiments are discussed herein, but many others will be appreciated, including use in cell phones, notebook computers, audio and video players, personalized advertisements (whether paper or electronic in nature), magazines, disposable packaging which includes audio prompting, and gifts.

A dynamic loudspeaker is comprised of a coil of wire located within the gap of a magnetic structure. FIG. 1 is a representation of the cross sectional view of a dynamic loudspeaker 20. The magnetic structure 21 consists of a soft iron pole piece that incorporates a permanent magnet 22. The magnetic field lines 25 produced by the permanent magnet 22 are contained within the high permeability soft iron pole piece 21. To complete the closed magnetic loop, the magnetic force lines 25 are forced to traverse the small air gap 28 as shown by the arrows. A coil of wire 23 located within this air gap 28 is attached to a diaphragm 26. When a voltage is applied through leads 27 to the coil 23, the resulting electric current through the coil 23 interacts with the magnetic field within the air gap 28 of the magnetic structure. The Lorentz force resulting from this interaction moves the diaphragm 26 to produce an audible signal in response to the applied voltage.

Inductive coupling to the voice coil 23 of the dynamic loudspeaker 20 can be accomplished with another magnetic structure, comprised of a pole piece and a coil of wire. When a voltage is applied to the coil of the second magnetic structure, the resulting electric current produces a magnetic field, as described by the Ampere-Maxwell law. When the second magnetic structure is placed in front of the dynamic loudspeaker 20, the magnetic field will traverse a path through the free space in front of the loudspeaker. This second magnetic structure thereby performs the function of an inductive antenna by producing a magnetic field in the free space in response to voltage applied to its own coil. As a result, a voltage signal applied to the coil of the inductive antenna will produce a changing magnetic field that in turn induces a voltage on the coil 23 of the loudspeaker 20, as described by Faraday's law of induction. Likewise, a voltage signal applied to the voice coil 23 of the loudspeaker 20 will induce a voltage on the coil of the inductive antenna. In this manner, the inductive coupling of the two coils allows a voltage signals to be transmitted across the air gap between the two structures. The voltage signal that is transmitted across the air gap may be used to transfer electrical power, or the voltage signal may be modulated in a manner that allows the transmission of analog or digital data across the link, or a combination of both functions.

DESCRIPTION OF THE DRAWINGS

FIG. 6A1 through 6A4 is an electronic schematic diagram of the preferred embodiment. The schematic has been divided into quarters in order to enlarge the letters and numbers.

FIG. 6B1 through 6B4 is an electronic schematic diagram for an alternative embodiment. The schematic has been divided into quarters in order to enlarge the letters and numbers.

DETAILED DESCRIPTION OF THE PREFERRED EMBODIMENTS

Figure 4:
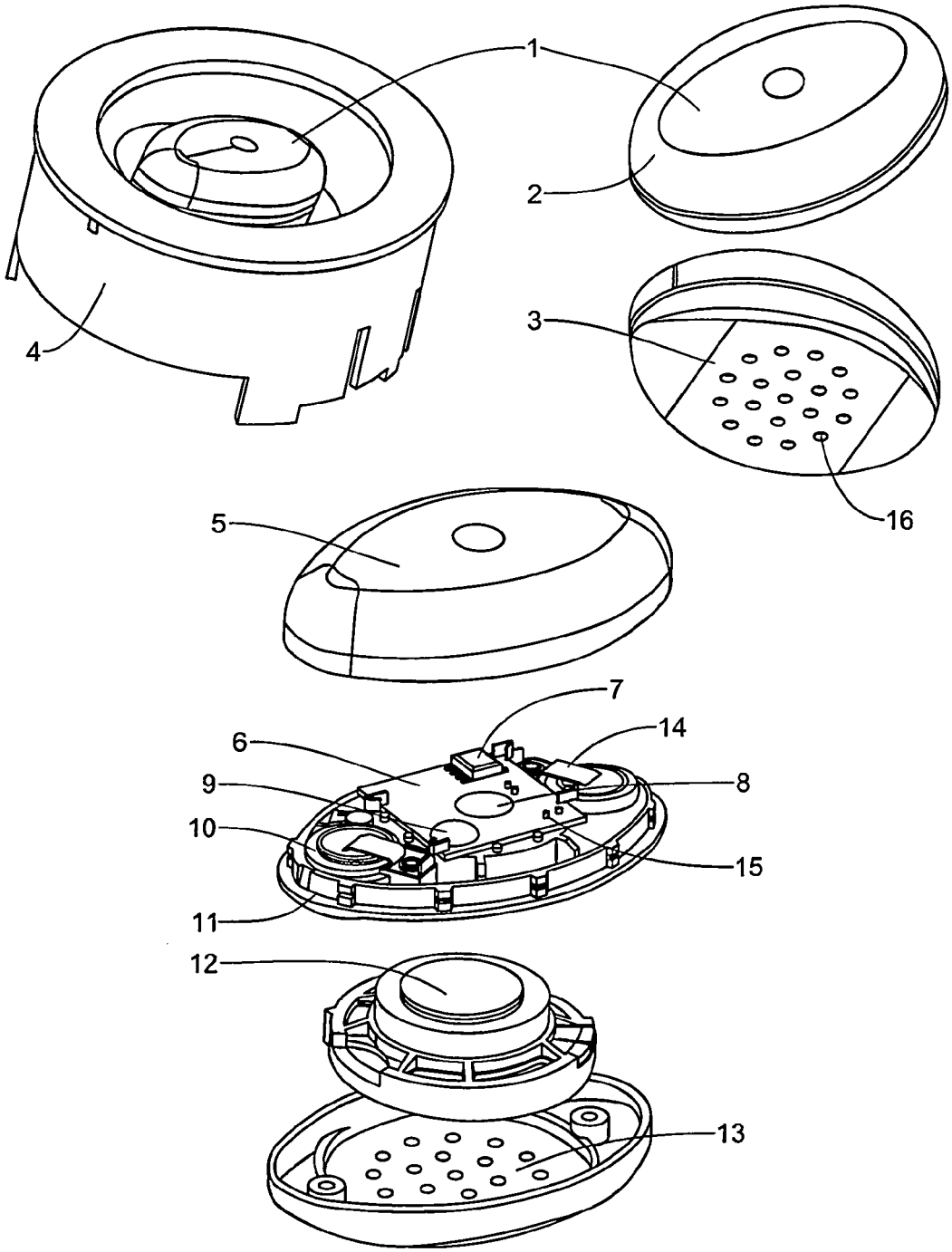
FIG. 4 is an exploded view of the components of a sound producing device and communication interface of the present invention.

FIG. 4 shows the preferred embodiment of the sound module and the communication device. The sound module 1 is shown located inside the programming cradle of the communication device 4. The top 2 and bottom 3 views of the sound module 1 are shown. The acoustic vent holes 16 for the loudspeaker 12 can be seen in the bottom view. The sound module 1 is constructed using a snap together top shell 5, center frame 11, and bottom shell 13. Mounted to and within the frame 11, are a printed circuit board 6, integrated circuit microprocessor 9, integrated circuit flash memory 7, battery power source 10, supporting electronic components 15, battery contacts 14, and triggering switch 8. Wrapped between the center frame 11 and the bottom shell 13 is the dynamic loudspeaker 12. The loudspeaker 12 is situated to allow for an unobstructed magnetic path between its voice coil and the inductive antenna in the programming cradle 4.

Figure 1:
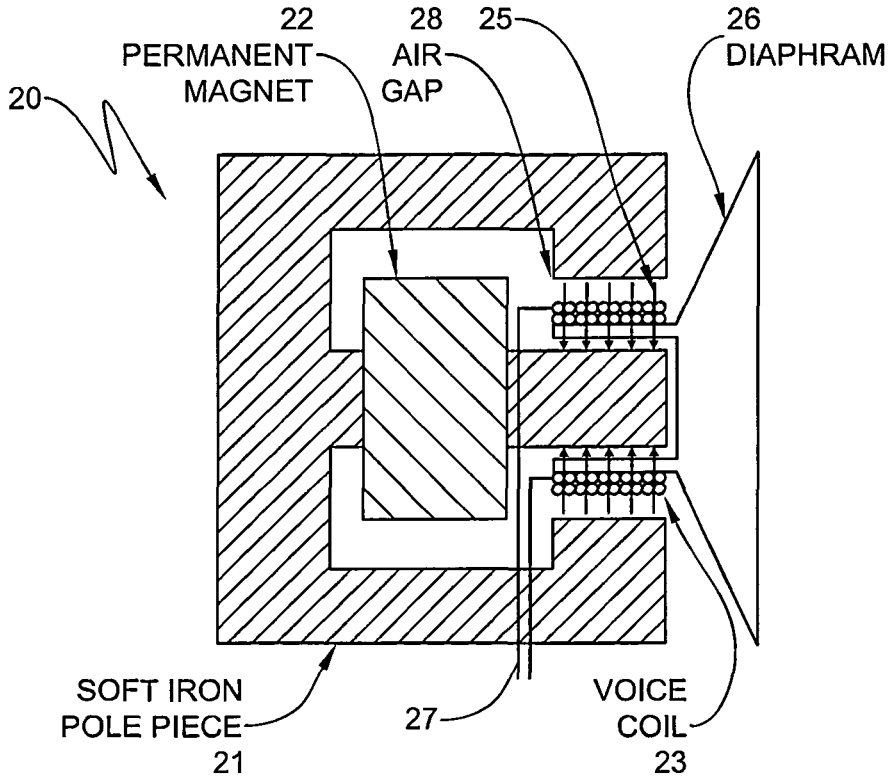
FIG. 1 (prior art)
FIG. 1 is a cross sectional view of a conventional audio module speaker.

A dynamic loudspeaker is comprised of a coil of wire located within the gap of a magnetic structure. FIG. 1 is a representation of the cross sectional view of a dynamic loudspeaker 20. The magnetic structure 21 consists of a soft iron pole piece that incorporates a permanent magnet 22. The magnetic field lines 25 produced by the permanent magnet 22 are contained within the high permeability soft iron pole piece 21. To complete the closed magnetic loop, the magnetic force lines 25 are forced to traverse the small air gap 28 as shown by the arrows. A coil of wire 23 located within this air gap 28 is attached to a diaphragm 26. When a voltage is applied through leads 27 to the coil 23, the resulting electric current through the coil 23 interacts with the magnetic field within the air gap 28 of the magnetic structure. The Lorentz force resulting from this interaction moves the diaphragm 26 to produce an audible signal in response to the applied voltage.

Figure 2:
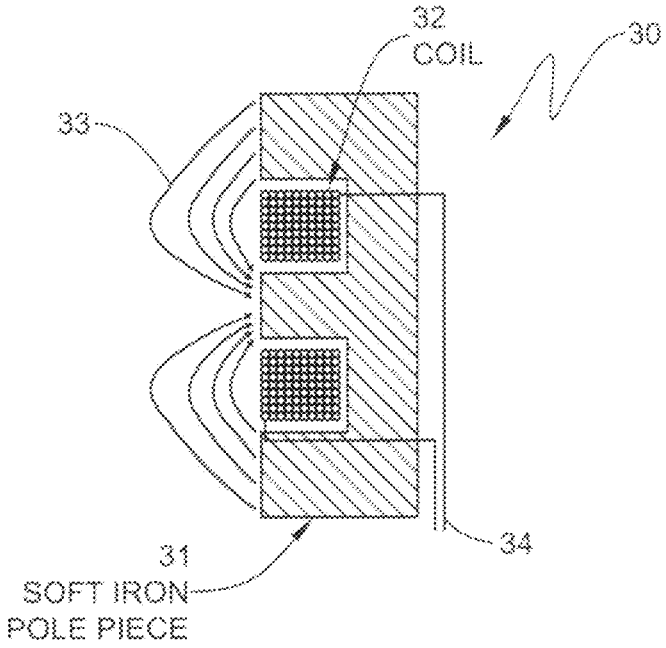
FIG. 2 is a cross sectional view of an inductive antenna structure.

Inductive coupling to the voice coil 23 of the dynamic loudspeaker 20 can be accomplished with another magnetic structure 30 comprised of a pole piece 31 and a coil of wire 32 within this structure, as shown in FIG. 2. The composition of this pole piece 31 can be any high permeability material such as soft iron, laminated steel or ferrite. When a voltage is applied to the coil 32 through electrical leads 32, the resulting electric current produces a magnetic field, as described by the Ampere-Maxwell law. The resulting magnetic field lines 33 are contained within the high permeability pole piece. However, to complete the closed magnetic loop, the magnetic field lines 33 will traverse a path through the free space in front of the pole piece as shown by the arrows. This structure 30 performs the function of an inductive antenna by producing a magnetic field 33 in free space in response to voltage applied to the coil 32.

Figure 3:
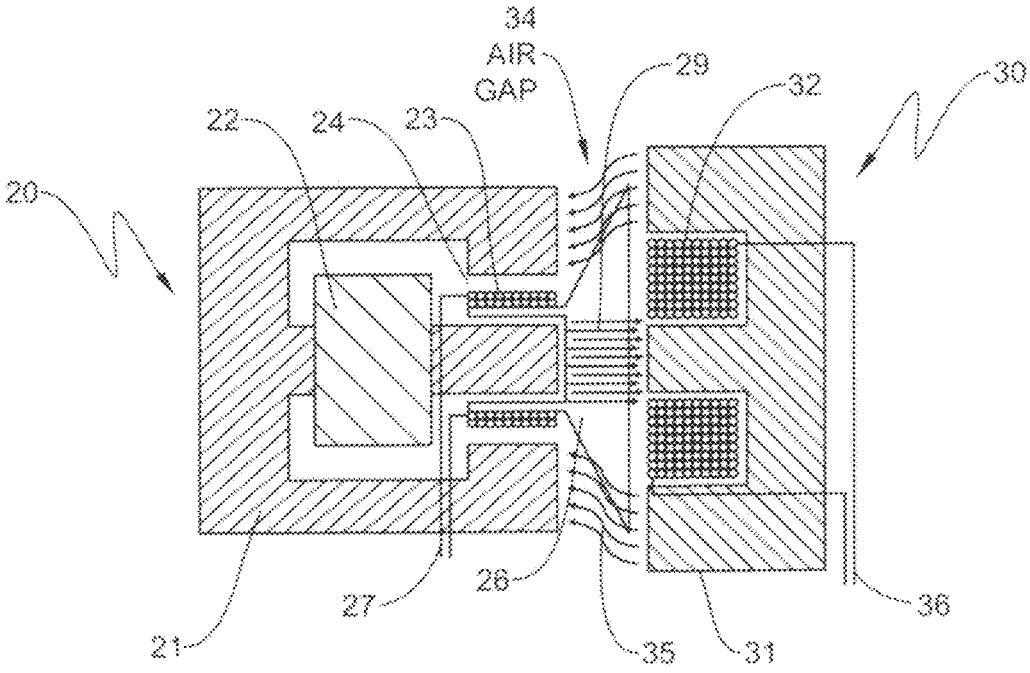
FIG. 3 is a cross sectional view of an audio module speaker in close proximity with an inductive antenna structure.

When the inductive antenna structure 30 is brought into close proximity to the loudspeaker 20, the magnetic field of the inductive antenna structure 30 will seek the path with the highest magnetic permeability. Since the soft iron pole piece 21 of the loudspeaker 20 has higher permeability than free space, the magnetic field lines 35 will preferentially traverse the smaller free space air gap 34 between the inductive antenna 30 and the loudspeaker 20 as shown in FIG. 3.

The magnetic field lines 35 form a loop which encompasses both the coil 32 in the inductive antenna structure 30 and the voice coil 23 in the loudspeaker 20. As a result, a voltage signal applied to the coil 32 of the inductive antenna 30 will produce a changing magnetic field that in turn induces a voltage on the coil 23 of the loudspeaker 20, as described by Faraday's law of induction. Likewise, a voltage signal applied to the voice coil 23 of the loudspeaker 20 will induce a voltage on the coil 32 of the inductive antenna 30. In this manner, the inductive coupling of the two coils, 23 and 32, allows a voltage signals to be transmitted across the air gap 34 between the two structures, 20 and 30.

The voltage signal that is transmitted across the air gap 34 may be used to transfer electrical power, or the voltage signal may be modulated in a manner that allows the transmission of analog or digital data across the link, or a combination of both functions.

The nature of this inductive coupling does not allow the DC component of a voltage signal to be coupled across the link. There are many modulation techniques suitable for encoding a data stream such that there is no DC component, such as OOK (on off keying), BPSK (binary phase shift keying), QAM (quadrature amplitude modulation) or 8B10B encoding. This data can represent the digitized audio to be saved in the memory of the sound module, or programmatic instructions that are executed in response to a stimulus.

Figure 5:
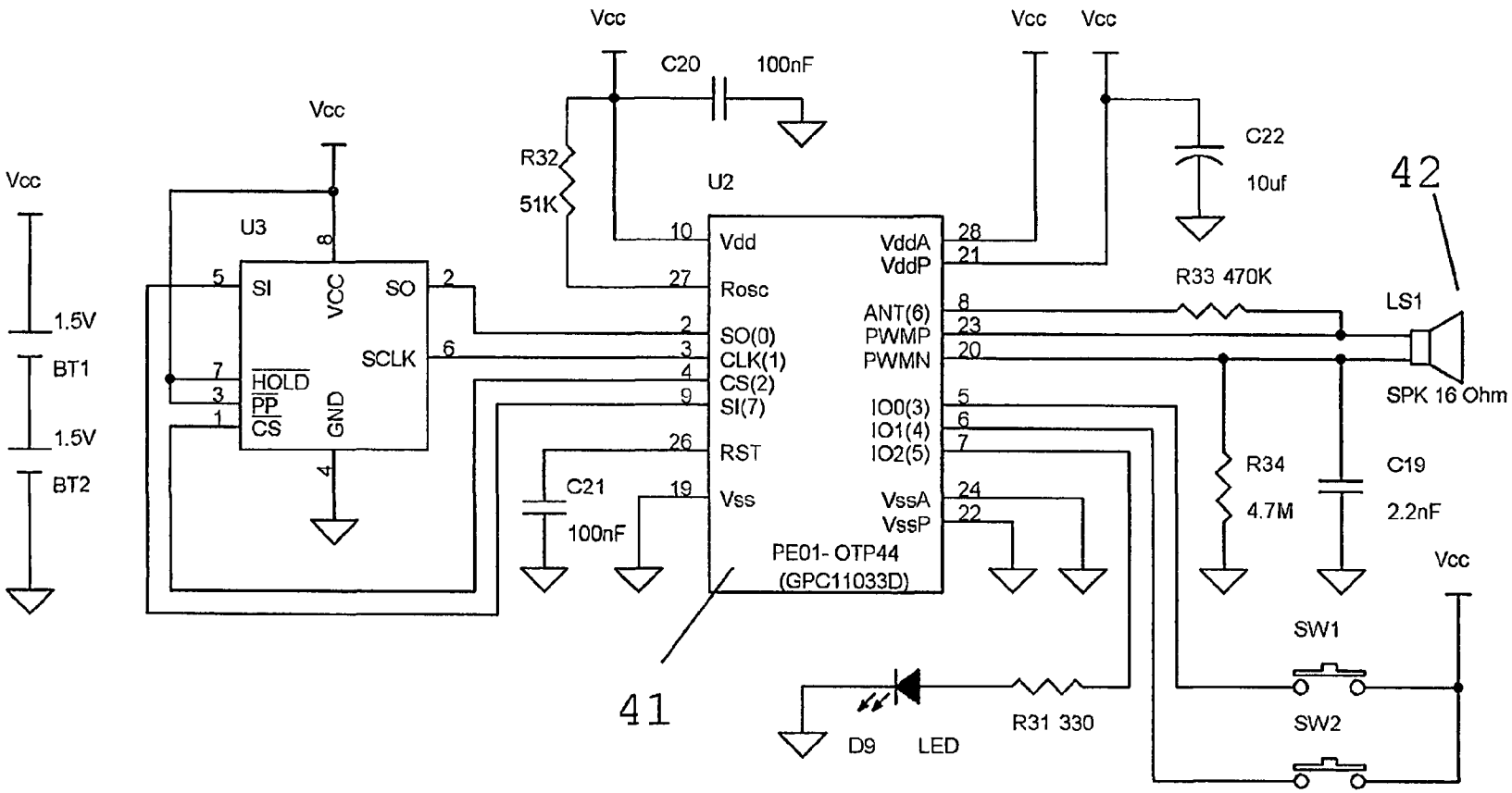
FIG. 5 is an electronic schematic diagram for the preferred embodiment.

FIG. 5 shows an electronic schematic diagram for the preferred embodiment. In this embodiment, the microcontroller 41 is a GeneralPlus GPC1 series microcontroller. This microcontroller is a CMOS 8 bit RISC processor with integrated program and data ROM, SRAM, programmable interval timers and counters, digital input/output ports and a PWMDAC (pulse width modulator digital to analog converter) capable of directly driving a dynamic loudspeaker 42 on the PWMP and PWMN port pins. The PWMP pin can also be configured as a digital input with a logic threshold of ½ Vcc. Additionally, the PWMN pin can be configured as a weak pull-up output with a pull-up impedance of approximately 470K Ohms. The input/output port labeled ANT(6) can be configured as a high impedance input or a totem-pole output. When the ANT(6) port is configured as a logic low output and the PWMN pull-up is activated, the resulting resistor divider using 470K Ohm resistor R2 causes the speaker voltage at the PWMP pin to be biased up to ½ Vcc. The polarity of the voltage signal induced on the loudspeaker coil will be detected by the input port on the PWMP pin.

When the sound module transmits data across the inductive link to the communication device, the loudspeaker is driven using the microcontroller's PWMDAC. The DAC is driven with a 100% positive or 100% negative duty cycle as required to transmit the 8B10B encoded data bits.

The ANT(6) port pin is also used to detect the presence of activity on the inductive link when the microcontroller is in the low-power sleep mode. When the microcontroller is in low-power mode, resistor R3 and capacitor C5 provide a weak ground signal on the side of the loudspeaker coil connected to pin PWMN. Pin ANT(6) is configured as a high-impedance input that will wake the microcontroller on a logic transition. With no induced voltage on the loudspeaker coil, the voltage on pin ANT(6) is also at ground potential. However, when a positive voltage of greater than ½ Vcc is induced on the loudspeaker coil, this voltage will cause a logic transition on pin ANT(6) causing the microcontroller to wake-up.

Input/output pins IO0(3), IO1(4) and IO2(5) can also be configured to wake the microprocessor on a logic level transition, such as occurs when pushbuttons SW1 or SW2 are pressed. The input/output pins can also be configured as outputs to drive LEDs, or other devices such as animation motors. For example, mouth and eye motor actuators can be driven in synchronization with the audio file that is played through the dynamic loudspeaker to animate a puppet.

Additional input/output pins SO, CLK, CS and SI are configured as an SPI (serial peripheral interface) to communicate with the non-volatile flash memory integrated circuit. This memory may contain the audio files for playback through the dynamic loudspeaker as well as script files which determine the programmatic operation of the sound module in response to pushbutton presses or other stimuli.

FIG. 6A shows the electrical schematic of the preferred embodiment of the communication device. In this embodiment, the microcontroller U1 51 is a Microchip 18F14K50 with an integrated USB interface on pins VUSB (17), D+ (18) and D− (19). The microcontroller contains data RAM, program ROM, a crystal controlled clock oscillator, an analog to digital converter, interval timers, voltage comparators, an I2C (inter-integrated circuit) interface and input/output ports.

The I2C bus on pins SDI (13) and SCL (11) is a two wire interface that allows the microcontroller to control the display LEDs, seen in FIG. 6B. These LEDs provide feedback to the user during time that a sound module is communicating with the communication device. Additionally, the I2C bus interfaces the microcontroller to the non-volatile RAM integrated circuits U7 and U8.

The inductive antenna is driven by an H-bridge composed of MOSFET transistors Q13, Q14, Q15 and Q16. The data source for the H-bridge are input/output pins RC6 (8) and RC7 (9). When the communication device is configured to receive signals from the inductive link, both RC6 and RC7 are driven to a logic zero state. Each side of the antenna is biased weakly to ½ Vcc by 100K Ohm resistors R13 and R14. Input/output port pins RC0 (16) and RC1 (15) are configured as voltage comparator inputs CIN+ and CIN−. The polarity of the induced voltage on the antenna is detected by this comparator. The output of the comparator drives port pin RC4 (6) which is configured as the comparator output COUT drives the 470K Ohm resistor R17 to provide positive feedback hysteresis to adjust the receive level sensitivity.

A magnetic Hall effect sensor HE1 is connected to input/output port pin RC3 (7) which is configured as an analog input to a 10 bit analog to digital converter (ADC). The Hall effect sensor is located adjacent to the inductive antenna in the programming cradle of the communication device. When a sound module is placed in the programming cradle, this sensor responds to the magnetic field generated by the permanent magnet of the dynamic loudspeaker in the sound module. This response is digitized by the ADC of the microcontroller. In this manner, the communication device can determine when a sound module is correctly placed in the programming cradle. If a sound module is placed upside down in the cradle, the orientation of the permanent magnet in the loudspeaker generates an opposite polarity magnetic field at the Hall effect sensor. Therefore, the Hall effect sensor can determine both the presence and the orientation of a sound module inserted into the programming cradle.

1. Description of an Exemplary Embodiment

An exemplary embodiment of this invention is composed of two assemblies. One assembly is the sound producing module that is comprised of a microcontroller integrated circuit, a clock oscillator, a dynamic loudspeaker that functions as both an audio transducer and an inductive link, an electric power source, digital memory, and input/output devices such as pushbuttons and LEDs. The other assembly is the inductive communication device that is used to transfer electrical energy and data across the inductive link to the sound producing module. The inductive communication device is comprised of a microcontroller integrated circuit, a clock oscillator, an electric power source, non-volatile memory, an inductive antenna with supporting driving and receiving electronics, display indicia such as LEDs, and a computer interface.

a. The Sound Producing Module

The sound producing module contains a microcontroller integrated circuit that includes an analog driver for outputting a signal sufficient for operating a loudspeaker. Many such microcontrollers include such functions as a digital to analog loudspeaker driver, an analog to digital converter, an analog voltage comparator, a digital counter, and a programmable interval timer. Multiplexing circuits in the microcontroller allow many of these functions to be connected to the same input/output pins of the microcontroller. This multiplexing circuitry is typically controlled by memory registers in the microcontroller. These registers may be modified under software control so that the same input/output pins of the microcontroller can be used to access these multiple functions as desired. In this manner, the loudspeaker may be connected to pins on the microcontroller that function both to drive the loudspeaker and to detect the induced voltage on the loudspeaker from the coupled link.

The input/output pins of a microcontroller typically include ESD (electro-static discharge) protection diodes such that any voltage applied to these pins that is either more positive than the Vss positive supply voltage or more negative than the negative supply voltage Vdd will forward bias these protection diodes allowing the current resulting from this excess voltage to be returned to the power source. The power source for the sound module could be a rechargeable secondary cell battery, or an energy storage capacitor. Therefore, if a voltage signal of sufficient amplitude is transmitted across the inductive link, the resulting current may be used to recharge the power source.

Microcontrollers may include analog to digital converters with between typically eight and sixteen bits of resolution suitable for measuring the voltage on the loudspeaker coil induced by the inductive link. For simpler modulation techniques, it is not necessary to measure the amplitude of the induced voltage with greater than a single bit of resolution. This can be accomplished by using a digital input port of the microcontroller to determine if the induced voltage is above or below the logic threshold level of the input port. Using the logic threshold of a digital input port to digitize an analog voltage to one bit of resolution allows a data link to be accomplished with a lower cost microcontroller that may not contain an analog to digital converter.

Microcontrollers often posses the capability of disabling the internal clock source to reduce power consumption. This is typically known as a "sleep" mode. The microcontroller can be configured to re-enable the clock in response to a logic level change on any of the digital input ports. For example, the microcontroller can remain in a "sleep" state until a pushbutton is pressed causing a logic transition on one of the input ports. The microcontroller can "wake-up" and respond to the button press. After performing the desired function, the microcontroller can then return to its sleep mode to conserve battery power. The voltage induced on the loudspeaker coil generated by the inductive link can also be used to wake the microcontroller. In this manner, the microcontroller can wake-up when activity is detected on the inductive link. Additionally, electrical contacts similar to a pushbutton can be incorporated into the loudspeaker structure such that the deflection of the diaphragm can cause closure of these contacts. The diaphragm can be connected to an air bladder such that squeezing the bladder can result in deflection of the diaphragm and closure of the contacts. In this manner, the microcontroller can detect squeezing an air bladder or directly pressing on the loudspeaker diaphragm.

For digital data to be transferred across the inductive link, it is typically necessary for the transmitting and receiving devices to synchronize to a common clock signal. When high accuracy, high stability oscillators are used for the transmitting and receiving devices, the devices utilize the clock signals from these oscillators to synthesize a common synchronized clock signal. However, low cost microcontrollers utilize less expensive oscillator components resulting in poor oscillator stability and reduced accuracy.

b. The Communication Device

The communication device houses the inductive antenna and contains a mechanical structure to allow for alignment of the antenna with the dynamic loudspeaker voice coil of the sound module. This device may also contain an interface means for transferring data to a personal computer. Such an interface means may be accomplished using a USB (universal serial bus), WiFi, Bluetooth, Ethernet, or any other commonly known means. The communication device allows digital data files from a computer to be uploaded or downloaded through the inductive link to the memory of the sound module. The non-volatile memory contained in the communication device may also be used to temporarily store the data file from the computer. In this manner, once the data file is transferred to the non-volatile memory, the interface to the computer may be removed. The data file may then be transferred to the sound module without the presence of a computer.

The modulation format for data transfer across the inductive link may require synchronization of the data clocks between the sound module and the communication device. For example, in the preferred embodiment, an 8B10B encoding scheme is used for data transfer. To minimize the cost of the sound module, the clock oscillator of the sound module may lack features which result in reduced accuracy and stability of the clock frequency. It is then necessary for communication device to compensate for the variable clock frequency of the sound module. Further, the polarity of the inductive link may be important for the modulation format. Rather than incurring cost for testing the polarity of the loudspeaker coil in the sound module, it is desirable for the communication device to automatically detect the polarity of the inductive link and correctly modulate the data based on the detected polarity. This is accomplished using the K28.1 and K28.5 "comma" characters. These characters are unique in that they contain a sequential run of five zeros or five ones. The sound module transmits these characters across the inductive link to the communication device. The communication device detects the timing of the run of five identical characters to determine the baud rate of the sound module. The communication device is able to adjust its data clock to match the data clock of the sound module based on the detected baud rate timing. Also, the sound module only transmits these characters with a predetermined polarity. The communication device is able to detect the actual received polarity of these characters. The communication device then determines the actual polarity of the inductive link and compensates if reverse polarity is detected.

2. Description of Alternate Embodiments

Figure 7:
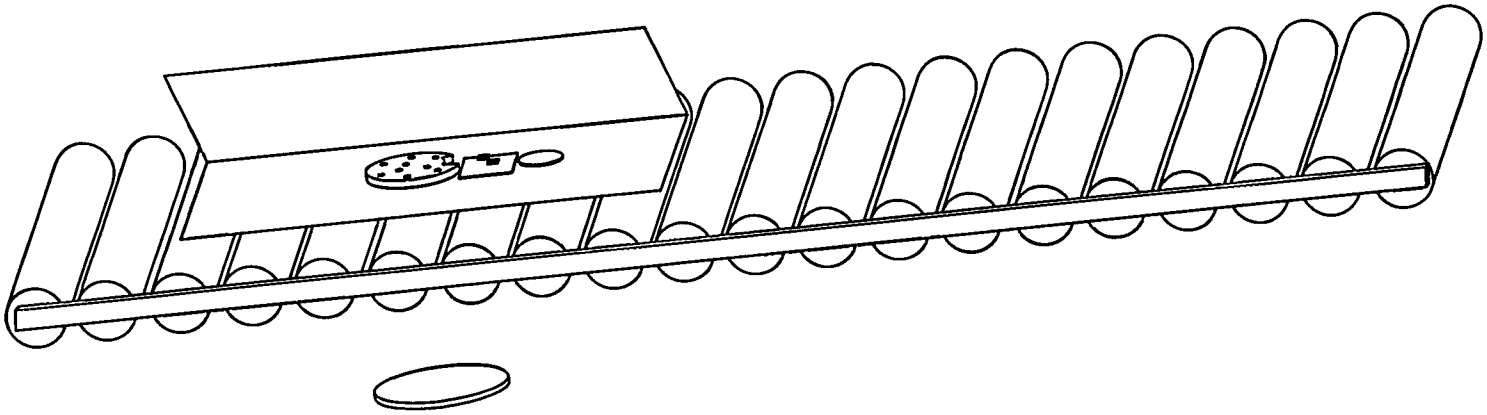
FIG. 7 is an alternative embodiment of the present invention.

A first alternate embodiment of the invention utilized in a sound producing electronic audio greeting card, shown in FIG. 7. The embodiment shown here for use in greeting cards is also applicable for use in Magazine advertisements, other papers and publications, and product packaging. The drawing shows greeting card 61 passing on or through standard process conveying equipment 62. When this application allows for rapid low-cost programming of an audio playback device whereby wired connection and human interaction is not required.

Although shown in a manufacturing environment, the wireless communication method shown here is also uniquely suited for the retail environment. Those skilled in the art, can readily identify the advantage of a low-cost wireless system as described by this invention which can be installed at a kiosk or the point-of-sale in the retail environment. Such a system, allows consumers to select custom audio material or provide their own audio content to be included or programmed inside the gift card or novelty at time of purchase. Since the sound module itself requires little or no additional cost to provide programming, products utilizing this invention can be sold for no additional cost over products which do not contain the ability to incorporate custom audio content.

Figure 8:
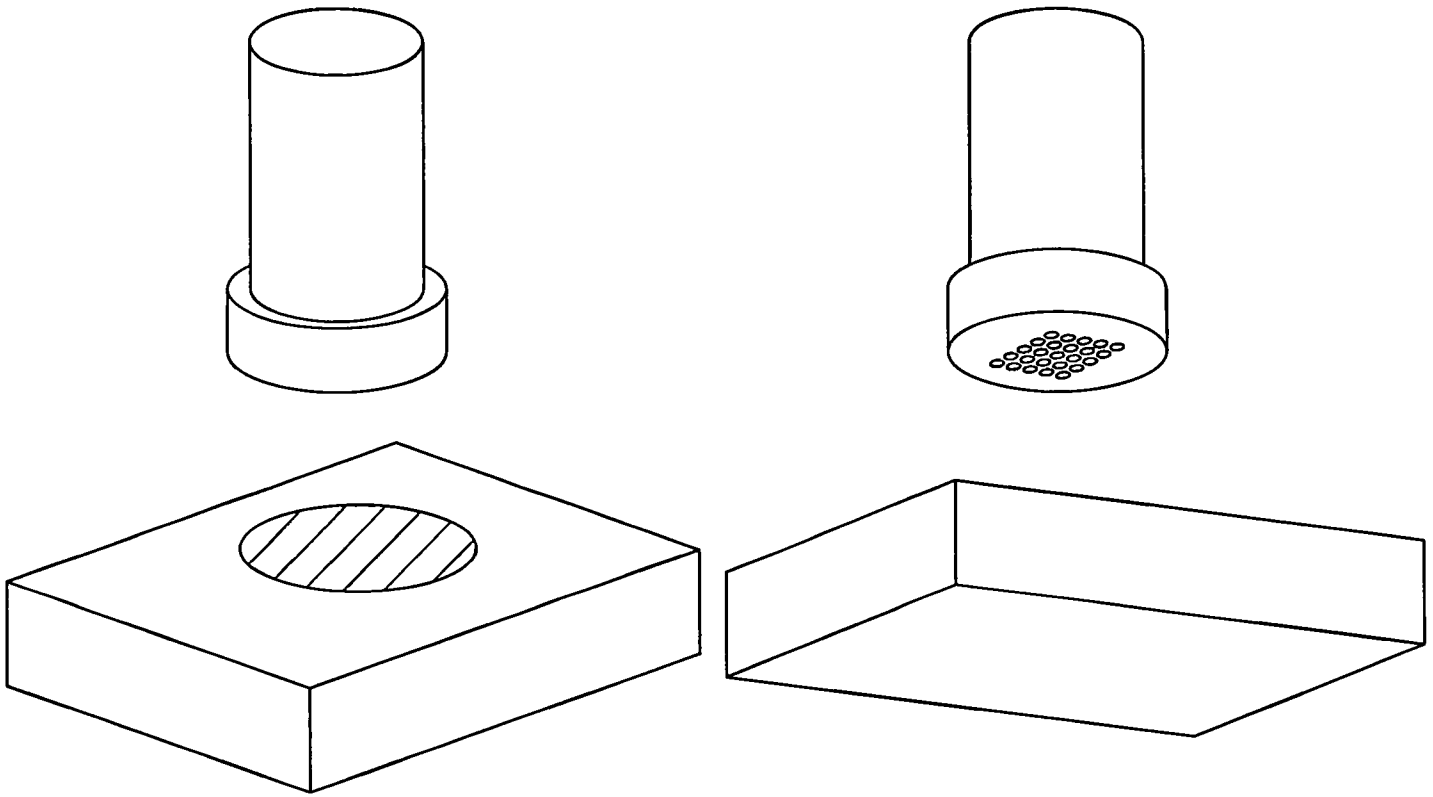
FIG. 8 is an alternative embodiment of the present invention.

A second alternate embodiment of the invention utilized in a sound producing dispensing and storage container, typically used for medications, as shown in FIG. 8. This embodiment utilizes the cap or top 71 of a pill bottle 72 to contain the sound module. In this application pharmacy personnel may place the pill bottle or bottle cap on a programming platform which will transfer a recorded message containing prescription dosage, drug interaction, medical instructions, or other medical information into the incorporated sound module. The programming platform may be directly control by the pharmacies computer systems or linked to central systems via the Internet. Such direct control and access to patient records can allow appropriate programming of audio messaging specific to patient needs and medications contained within the bottle. Direct human interaction other than placing the container on the programming platform may not be required. The invention can also contain timekeeping means and a sensor which detects when a pill has been removed from the bottle. The invention can record actual dosage times in its non-volatile memory. This information can be used to trigger audible alarms or warnings of underdoses or overdoses. Those skilled in the art, can recognize the advantage of a low-cost audio messaging system that can provide pertinent medical and safety information to those who cannot, or choose not, to review printed information.

A third alternate embodiment may substitute the inductive data link for a radio frequency data link using the speaker voice coil as the antenna. This embodiment may be preferred at such time as the integrated circuit processor incorporates the necessary electronic circuitry to decode the data present within the radio frequency signal.

The drawings and description set forth here represent only some embodiments of the invention. After considering these, skilled persons will understand that there are many ways to make a programmable sound recording and playback device according to the principles disclosed. The inventors contemplate that the use of alternative structures, materials, or manufacturing techniques, which result in a programmable sound recording and playback device according to the principles disclosed, will be within the scope of the invention.

We claim:

1. An inductive coupler system, comprising:

a dynamic loudspeaker comprising a loudspeaker pole piece having a loudspeaker interior space and a loudspeaker aperture, a loudspeaker magnet located within the loudspeaker interior space of the loudspeaker pole piece, a loudspeaker coil located within the loudspeaker aperture of the loudspeaker pole piece, conductive loudspeaker leads electrically coupled to the loudspeaker coil, and a loudspeaker diaphragm connected to the loudspeaker coil, an inductive antenna adjacent said dynamic loudspeaker, the inductive antenna comprising an antenna magnetic structure, the antenna magnetic structure comprising an antenna pole piece having an antenna coil space, an antenna coil located within the antenna coil space, and conductive antenna leads electrically coupled to the antenna coil, an inductive antenna voltage source coupled to the antenna leads of the inductive antenna, said inductive antenna voltage source comprising data, said inductive antenna voltage source producing an inductive antenna magnetic field, said inductive antenna magnetic field inducing a loudspeaker voltage on the loudspeaker coil, wherein the inductive antenna magnetic field conveys the data and the data is transferred to the dynamic loudspeaker through the induced loudspeaker voltage received by the loudspeaker coil and loudspeaker leads, and a sound module comprising a microprocessor and memory storage, wherein said loudspeaker leads are electrically coupled to the sound module microprocessor, and wherein the data received over the loudspeaker leads from the dynamic loudspeaker can be stored in the memory storage of the sound module.

2. The inductive coupler system of claim 1, wherein the data comprises sound signals used by the sound module to drive the loudspeaker diaphragm to produce a sound.

3. The inductive coupler system of claim 1, wherein:

said sound module further comprises a battery power source and said battery power source is electrically coupled to the sound module microprocessor, and wherein the loudspeaker voltage on the loudspeaker coil induced by the inductive antenna magnetic field further comprises electrical power and the electrical power is provided to the battery power source.

4. The inductive coupler system of claim 3, wherein the microprocessor of said sound module further comprises a low-power sleep mode, and wherein the sound module further comprises a switch to deactivate the low-power sleep mode.

5. The inductive coupler system of claim 4, wherein the switch is a manual pressure-activated switch.

6. The inductive coupler system of claim 1, wherein:

said sound module further comprises a battery power source and a module voltage source, the inductive antenna voltage source further comprises an inductive antenna microprocessor, and the module voltage source is coupled to the loudspeaker leads, said module voltage source comprising module data, said module voltage source producing an inductive loudspeaker magnetic field, said inductive loudspeaker magnetic field inducing an antenna voltage on the antenna coil, wherein the inductive loudspeaker magnetic field conveys the module data and the module data is transferred to the inductive antenna through the induced antenna voltage received by the antenna coil and antenna leads, and wherein the module data is received by the inductive antenna microprocessor over the antenna leads.

7. A dynamic loudspeaker and inductive antenna system comprising:

a dynamic loudspeaker comprising a voice coil, a loudspeaker diaphragm driven by said voice coil, and a first magnetically permeable structure allowing magnetic flux to couple said voice coil, an inductive antenna comprising an antenna coil and a second magnetically permeable structure allowing magnetic flux to couple said antenna coil, wherein data is transmitted or received between the dynamic loudspeaker and the inductive antenna via modulation of magnetically coupled flux between the dynamic loudspeaker voice coil and the inductive antenna.

8. The dynamic loudspeaker and inductive antenna system of claim 7, wherein the modulation is magnetically balanced to minimize magnetic saturation of at least one of the first or second magnetically permeable structures and maximize magnetic coupling between the first and second magnetically permeable structures.

9. The dynamic loudspeaker and inductive antenna system of claim 8, wherein the magnetically balanced modulation is a modulation technique suitable for encoding the data to reduce a direct current component.

10. The dynamic loudspeaker and inductive antenna system of claim 7, wherein the second magnetically permeable structure of the inductive antenna has a geometric shape maximizing strength of the magnetic flux coupled to the dynamic loudspeaker.

11. The dynamic loudspeaker and inductive antenna system of claim 10, further comprising an antenna axis through the antenna coil, and a dynamic loudspeaker axis through the voice coil, wherein the geometric shape of the second magnetically permeable structure aligns the antenna axis with the dynamic loudspeaker axis, thereby maximizing strength of the magnetic flux coupled to the dynamic loudspeaker.

12. The dynamic loudspeaker and inductive antenna system of claim 7, wherein the inductive antenna is coupled to a microprocessor controlling the modulation of the magnetically coupled flux transmitted or received between the dynamic loudspeaker and the inductive antenna.

13. The dynamic loudspeaker and inductive antenna system of claim 12, wherein the microprocessor synchronizes data transmitted from the dynamic loudspeaker and the inductive antenna.

14. The dynamic loudspeaker and inductive antenna system of claim 13, wherein the microprocessor synchronizes the data by analyzing a data clock rate and a data polarity of the data transmitted and received between the dynamic loudspeaker and the inductive antenna.

15. The dynamic loudspeaker and inductive antenna system of claim 7, wherein the modulation of magnetically coupled flux from the inductive antenna further transmits electric power to the dynamic loudspeaker via modulation of magnetically coupled flux from the inductive antenna to the dynamic loudspeaker.

16. A dynamic loudspeaker and inductive antenna system comprising:

a dynamic loudspeaker comprising a voice coil, a loudspeaker diaphragm driven by said voice coil, and a first magnetically permeable structure allowing magnetic flux to couple said voice coil, an inductive antenna comprising an antenna coil and a second magnetically permeable structure allowing magnetic flux to couple said antenna coil, wherein electric power is transmitted from the inductive antenna and received by the dynamic loudspeaker via modulation of magnetically coupled flux from the inductive antenna to the dynamic loudspeaker.

17. The system of claim 16, wherein data is transmitted or received between the dynamic loudspeaker and the inductive antenna via the modulation of magnetically coupled flux between the dynamic loudspeaker voice coil and the inductive antenna.

18. A dynamic loudspeaker and electromagnetic antenna system comprising:

a dynamic loudspeaker comprising a voice coil, a loudspeaker diaphragm driven by said voice coil, and a first magnetically permeable structure allowing electromagnetic energy to couple said voice coil, an electromagnetic antenna comprising an antenna coil and a second magnetically permeable structure allowing electromagnetic energy to couple said antenna coil, wherein data is transmitted or received between the dynamic loudspeaker and the electromagnetic antenna via modulation of electromagnetic energy between the dynamic loudspeaker voice coil and the inductive antenna.

19. The dynamic loudspeaker and electromagnetic antenna system of claim 18, wherein the modulation of electromagnetic energy from the electromagnetic antenna further transmits electric power to the dynamic loudspeaker via modulation of electromagnetic energy from the electromagnetic antenna to the dynamic loudspeaker.

* * * * *